US011672274B2

(12) United States Patent
Baldanza et al.

(10) Patent No.: US 11,672,274 B2
(45) Date of Patent: Jun. 13, 2023

(54) MACHINE FOR MAKING CIGARETTE FILTERS AND METHOD FOR MAKING CIGARETTE FILTERS

(71) Applicant: G.D S.P.A., Bologna (IT)

(72) Inventors: Nicola Baldanza, Zola Predosa (IT); Ivan Eusepi, Castelmaggiore (IT); Eros Stivani, Bologna (IT); Massimo Sartoni, Bologna (IT)

(73) Assignee: G.D S.P.A., Bologna (IT)

( * ) Notice: Subject to any disclaimer, the term of this patent is extended or adjusted under 35 U.S.C. 154(b) by 505 days.

(21) Appl. No.: 16/070,348

(22) PCT Filed: Jan. 17, 2017

(86) PCT No.: PCT/IB2017/050237
§ 371 (c)(1),
(2) Date: Jul. 16, 2018

(87) PCT Pub. No.: WO2017/125849
PCT Pub. Date: Jul. 27, 2017

(65) Prior Publication Data

US 2019/0090532 A1 Mar. 28, 2019

(30) Foreign Application Priority Data

Jan. 21, 2016 (IT) ..... 102016000005833

(51) Int. Cl.
*A24D 3/02* (2006.01)
*A24D 3/04* (2006.01)

(52) U.S. Cl.
CPC ..... *A24D 3/0233* (2013.01); *A24D 3/0279* (2013.01); *A24D 3/04* (2013.01)

(58) Field of Classification Search
CPC ..... A24D 3/0233; A24D 3/0279; A24D 3/04
(Continued)

(56) References Cited

U.S. PATENT DOCUMENTS 2,609,312 A * 9/1952 Farrell ..... D04B 9/44 264/103
3,377,220 A 4/1968 Berger et al.
(Continued)

FOREIGN PATENT DOCUMENTS

CN 1579628 2/2005
CN 201630230 U 11/2010
(Continued)

OTHER PUBLICATIONS

International Search Report and Written Opinion dated Apr. 11, 2017 for counterpart PCT Application No. PCT/IB2017/050237.
(Continued)

*Primary Examiner* — Sameh Tawfik
(74) *Attorney, Agent, or Firm* — Shuttleworth & Ingersoll, PLC; Timothy J. Klima

(57) ABSTRACT

A machine for making cigarette filters and which includes a forming beam having an internal channel whose transverse cross section changes shape along the main longitudinal direction of the channel. Porous conveyor means carry the tow along a feed path in the channel complying with the shape thereof and thereby being wrapped around the tow. At least one treatment station located along the feed path includes a nozzle for blowing a flow of steam into the channel. The nozzle includes a plurality of planar sectors positioned transversely to the channel and defining an overall planar flow orifice placed directly in communication with a steam feed duct. Each planar sector defines a respective planar flow orifice and at least two flow orifices have different thicknesses.

23 Claims, 4 Drawing Sheets

(58) Field of Classification Search
USPC ..... 493/44, 39, 48, 50
See application file for complete search history.

(56) References Cited

U.S. PATENT DOCUMENTS

| | | | | | |
|---|---|---|---|---|---|
| 3,405,717 | A * | 10/1968 | Berger | A24D 3/02 | 131/94 |
| 3,552,400 | A * | 1/1971 | Berger | A24D 3/0208 | 131/339 |
| 3,852,009 | A * | 12/1974 | Roberts | A24D 3/0233 | 425/83.1 |
| 4,115,498 | A * | 9/1978 | Kissell | B28B 1/52 | 264/119 |
| 4,655,230 | A * | 4/1987 | Bryant | D06B 3/045 | 131/343 |
| 4,747,814 | A * | 5/1988 | Berger | A24D 3/0233 | 156/441 |
| 4,752,348 | A * | 6/1988 | Bryant | A24D 3/02 | 131/343 |
| 6,723,669 | B1 * | 4/2004 | Clark | D04H 1/43838 | 442/347 |
| 9,392,819 | B2 * | 7/2016 | Giannini | A24D 3/0233 | |
| 2003/0173418 | A1 * | 9/2003 | Koborinai | A24D 3/022 | 239/292 |

FOREIGN PATENT DOCUMENTS

| | | | |
|---|---|---|---|
| CN | 103300473 | B | 9/2013 |
| EP | 2548625 | A1 | 1/2013 |
| EP | 2636321 | A1 | 9/2013 |
| GB | 1221346 | | 2/1971 |
| JP | H11507994 | A | 7/1999 |
| JP | 2013183738 | A | 9/2013 |
| SU | 423266 | A3 | 4/1974 |
| WO | 8800524 | A1 | 1/1988 |

OTHER PUBLICATIONS

Russian Search Report and Decision to Grant dated Apr. 27, 2020 from counterpart Russian patent application No. 2018124321.
Chinese Office Action dated Mar. 12, 2020 from counterpart Chinese Patent Application No. 201780007475.5.
Chinese Supplemental Search Report dated Aug. 25, 2020 from counterpart Chinese Patent Application No. 201780007475.5.
Chinese Notice to Granted dated Sep. 3, 2020 from counterpart Chinese Patent Application No. 201780007475.5.
Japanese Office Action dated Feb. 2, 2021 from counterpart Japanese Patent Application No. 2018-538206.

* cited by examiner 16e,17e
16d
15
T
16a
17
18c
7
11
A
18
9
3
16c
18d
9a
18a
16b
18b
16d
17a
17d
17d
17b
17c 2
23
24
X
14
24
13
14
9a
12
19
19a
25
9
3

III
III
14
2
15
9a
9
3

MACHINE FOR MAKING CIGARETTE FILTERS AND METHOD FOR MAKING CIGARETTE FILTERS

This application is the National Phase of International Application PCT/IB2017/050237 filed Jan. 17, 2017 which designated the U.S.

This application claims priority to Italian Patent Application No. 102016000005833 filed Jan. 21, 2016, which application is incorporated by reference herein.

TECHNICAL FIELD

This invention relates to a machine for making cigarette filters and to a method for making cigarette filters.

BACKGROUND ART

In the prior art, cigarette filters are made from a strip of filter material, usually cellulose acetate, which is drawn out, stretched and treated with additive materials, in particular plasticizing fluids (triacetin, for example) to form a tow of filter material. The tow is processed and subjected to the action of process fluids, such as steam, for example, to obtain a filter rod from which individual pieces of filter are cut.

Document U.S. Pat. No. 3,377,220 describes a station for processing a tow of filter material where a flow of steam from an external source is fed to an elongated chamber and brought into contact with the tow through a plurality of radial ducts.

This solution has some drawbacks connected with the fact that the path followed by the steam is not an optimum one since it has to traverse an elongated chamber and is not uniform because it is radially concentrated in the ducts.

Another known solution is disclosed in EP2636321 in which the steam is fed in an accumulation chamber surrounding the forming channel and communicating with the forming channel through an annular nozzle.

DISCLOSURE OF THE INVENTION

This invention therefore has for an aim to provide a machine for making cigarette filters and a method for making cigarette filters to overcome the drawbacks mentioned above with reference to the prior art.

More specifically, the aim of this invention is to provide a machine for making cigarette filters and a method for making cigarette filters capable of optimizing and making uniform the flow of steam which comes into contact with the tow.

These aims are achieved by a machine for making cigarette filters and a method for making cigarette filters having the features set out in one or more of the appended claims.

Advantageously, the filter making machine and method of this invention allow obtaining a better distribution of the steam flow transversely to the tow to be treated.

BRIEF DESCRIPTION OF THE DRAWINGS

Further features and advantages of the invention are more apparent from the following exemplary and therefore non-limiting description of a preferred and hence non-exclusive embodiment of a machine for making cigarette filters and a method for making cigarette filters.

The invention is described below with reference to the accompanying drawings, which illustrate a non-limiting embodiment of it and in which.

DETAILED DESCRIPTION OF PREFERRED EMBODIMENTS OF THE INVENTION

Figure 8:
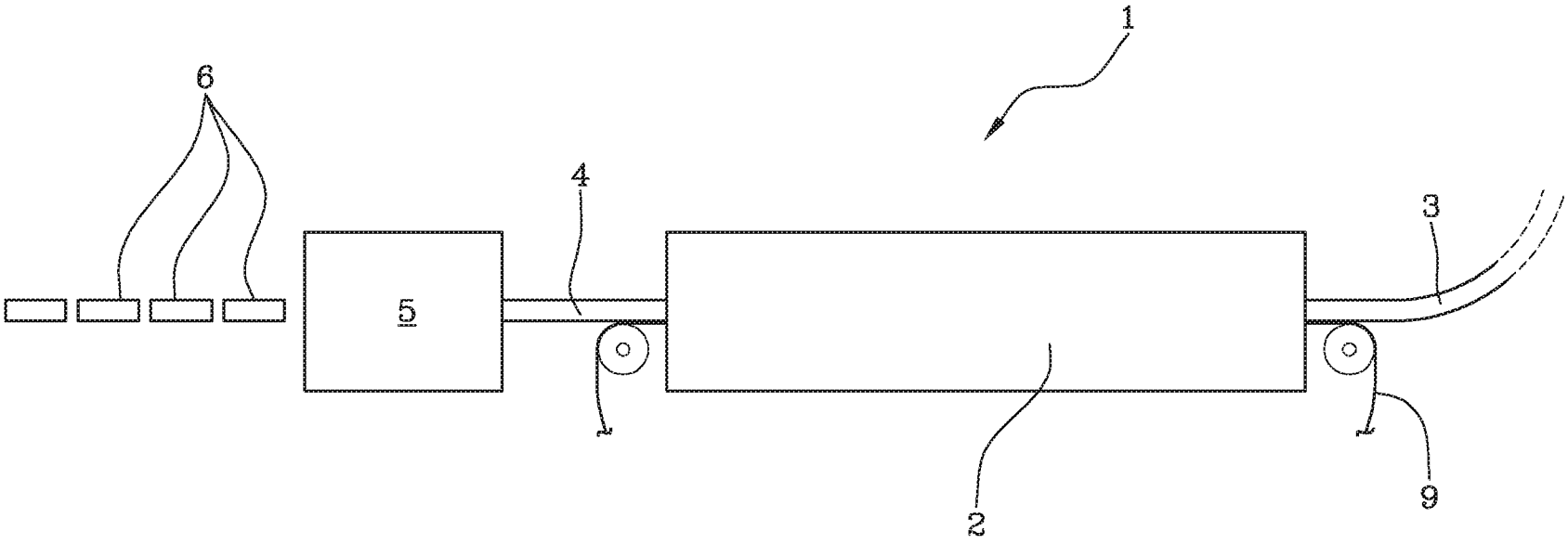
FIG. 8 is a schematic view of a machine for making cigarette filters.

With reference to FIG. 8, a machine for making cigarette filters is denoted in its entirety by the numeral 1.

The making machine 1 comprises a forming beam 2 configured to receive a tow 3 of filter material. The tow 3 of filter material—cellulose acetate for example—comes from one or more processing stations, not illustrated. Preferably, the filter material is drawn out from compressed bales of filter tow material and made to advance through the above mentioned processing stations where it is first stretched and then impregnated with a plasticizing fluid such as triacetin, for example. Thus, the tow 3 of filter material which reaches the forming beam 2 is impregnated with a plasticizing fluid.

Along the forming beam, the tow 3 is folded on itself about its longitudinal axis to form a continuous rod 4 of filter material.

The making machine 1 also comprises cutting means 5 adapted to cut the rod 4 transversely into a plurality of pieces 6 whose longitudinal dimensions are suitable for the subsequent processes.

Figure 1:
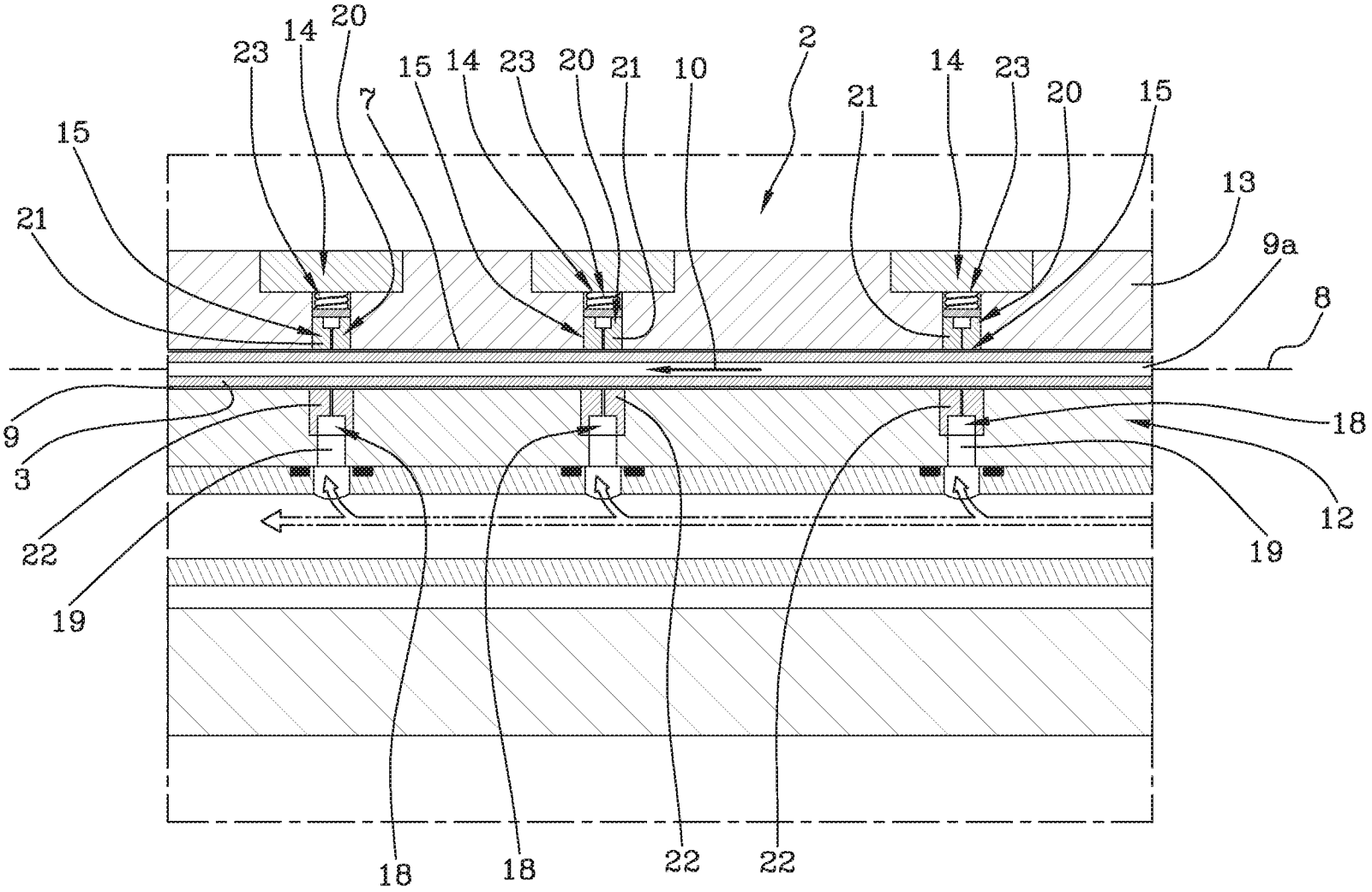
FIG. 1 is a view in cross section of a detail of a forming beam of a machine for making cigarette filters.
Figure 3A:
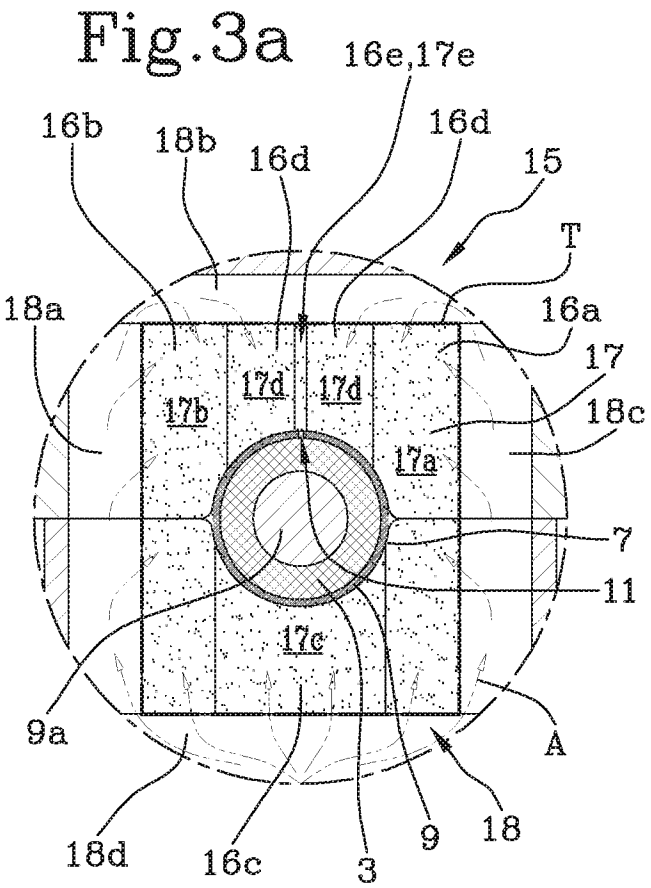
FIG. 3*a* shows an enlarged view of the detail X from FIG. 3.
Figure 3:
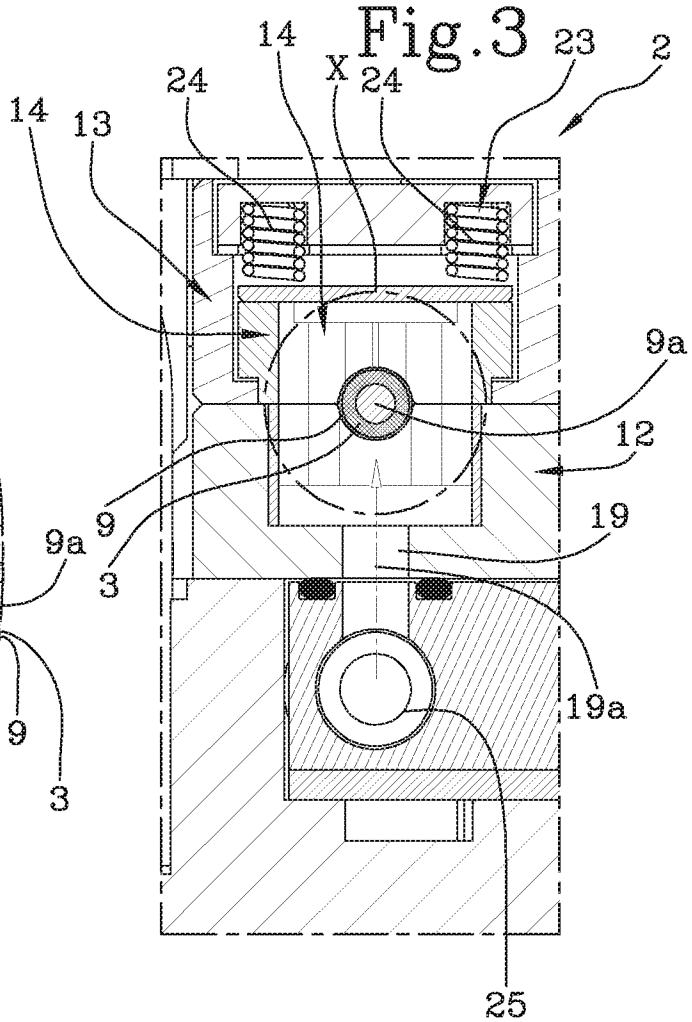
FIG. 3 is a cross-section through the line III-III of FIG. 2.
Figure 2:
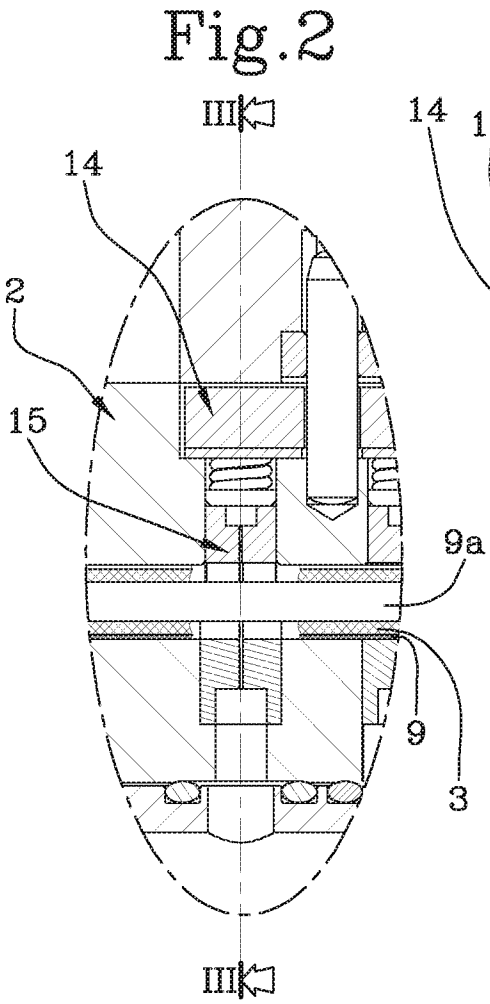
FIG. 2 is an enlarged detail from FIG. 1.
Figure 6:
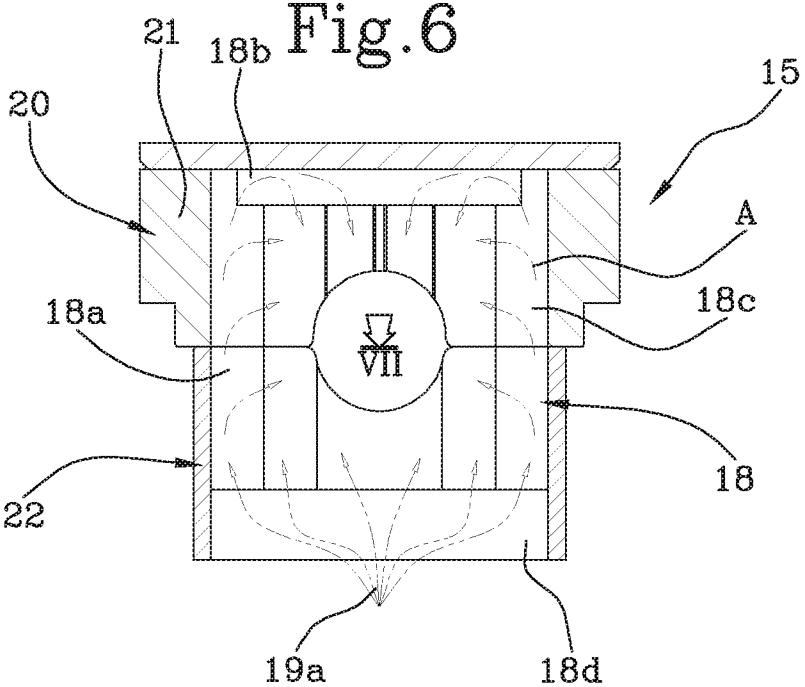
FIG. 6 is an enlarged detail from FIG. 3.
Figure 7:
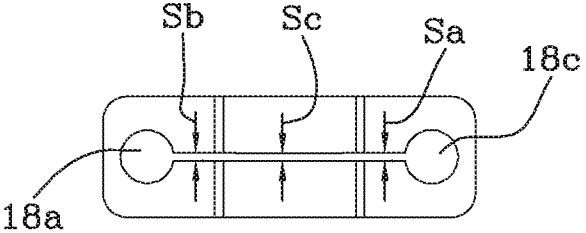
FIG. 7 is a view according to the arrow VII of the detail of FIG. 6.
Figure 4:
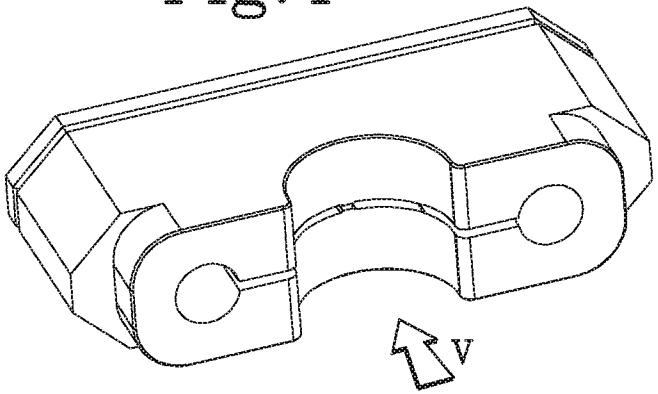
FIG. 4 is a perspective view of a detail from FIG. 1.
Figure 5:
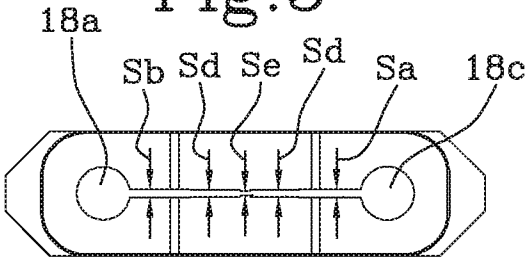
FIG. 5 shows a front view of the detail of FIG. 4 according to the arrow V.

The forming beam 2 has an internal channel 7 which extends along a main longitudinal direction 8 (FIGS. 1-3).

The channel 7 is adapted to receive the tow 3 and its transverse cross section changes along the main longitudinal direction 8 in such a way as to impart a predetermined shape to the tow 3 to form the rod 4.

The numeral 9 denotes porous conveyor means—for example, a conveyor belt made of material permeable to air and steam—configured to slide in the channel 7 of the forming beam 2 along the main longitudinal direction 8. The conveyor means are also configured to carry the tow 3 along a feed path 10. In the embodiment illustrated in the drawings, a mandrel 9*a* is used to make a rod 4 with a longitudinal hole in it suitable for making flow filters. Alternatively, the mandrel 9*a* may be omitted.

The conveyor means 9 are also adapted to comply with the shape of the transverse cross section of the channel 7 and to be at least partly wrapped around the tow 3. Preferably, in the configuration where the conveyor means 9 are wrapped as far as possible circumferentially around the tow 3, the conveyor means 9 do not overlap and leave a portion 11 (FIG. 3*a*) of the tow 3 uncovered.

Preferably, the forming beam 2 comprises a base 12 and a cover 13 closable over the base 12 along a plane parallel to the main longitudinal direction 8 to form the channel 7. Still more preferably, the base 12 has one half-portion of the channel 7, for example, the lower half-portion, and the cover 13 has the other half-portion of the channel 7, for example, the upper half-portion, so that the channel 7 is obtained in a configuration where the cover 13 is fitted over the base 12.

The making machine 1 comprises at least one treatment station 14 located along the feed path 10 and comprising at least one nozzle 15 configured to blow a flow of steam into the internal channel 7 transversely thereto. FIG. 1 shows three treatment stations 14 distributed along the feed path 10. In alternative embodiments, there may be one or more treatment stations 14 distributed in various ways along the feed path 10.

With reference to FIGS. 2-7, in particular FIG. 3*a*, the nozzle 15 comprises a plurality of planar sectors 16*a*-16*e* positioned transversely to the internal channel 7.

Preferably, the planar sectors 16*a*-16*e* are in communication with each other, defining an overall, uninterrupted planar flow orifice 17 around the internal channel 7. The overall planar flow orifice 17 is shown in FIG. 3*a* and is suitable for producing a steam blade leading into the channel 7. The overall planar flow orifice 17 is in direct communication with a steam feed duct 18 positioned around the channel 7, for example at a lateral section of the feed duct itself which, in FIG. 3*a* is schematically represented by the dashed line "T".

Preferably, the feed duct 18 extends along a feed path "A" which is polygonal in shape, preferably rectangular for example, comprising arms 18*a*-18*d*.

The numeral 19 denotes an inlet duct of the feed duct 18, for example formed in the base 12 of the forming beam 2. The inlet duct 19 defines a steam flow direction 19*a*.

In a possible embodiment, the planar sectors 16*a*-16*e* run parallel to the steam flow direction 19*a* along the inlet duct 19.

In a possible embodiment, the nozzle 15 comprises at least two lateral planar sectors 16*a*, 16*b* located laterally of the internal channel 7 relative to the inlet duct 19, at least one front planar sector 16*c* located between the inlet duct 19 and the channel 7 and at least one rear planar sector 16*d* located on the opposite side of the channel 7 relative to the inlet duct 19.

In a possible embodiment, the nozzle 15 comprises a compensating planar sector 16*e* giving onto the portion 11 of the tow 3 not wrapped by the porous conveyor means 9. Preferably, the compensating planar sector 16*e* is located on the opposite side of the internal channel 7 relative to the inlet duct 19, at a central position between two rear planar sectors 16*d*.

Preferably, the planar sectors 16*a*-16*e* run parallel to one side of the feed path "A", for example parallel to the arms 18*a*, 18*c* of the feed duct 18.

Each planar sector 16*a*-16*e* defines a corresponding flow orifice 17*a*-17*e* in direct communication with the steam feed duct 18. In the example illustrated in the drawings, the flow orifices 17*a*-17*e* correspond to portions of the overall planar flow orifice 17.

All the flow orifices 17*a*-17*e* lead directly into the channel 7.

Each flow orifice 17*a*-17*e* has a respective thickness "Sa"-"Se" measured along the main longitudinal direction 8. At least two of the flow orifices 17*a*-17*e* differ in thickness.

Preferably, the lateral planar sectors 16*a*, 16*b* have respective thicknesses "Sa", "Sb" which are greater than the thickness "Sc" of the front planar sector 16*c* and/or the thickness "Sd" of the rear planar sector 16*d*.

Preferably, the lateral planar sectors 16*a*, 16*b* have respective thicknesses "Sa", "Sb" which are the same and preferably between 0.3 mm and 0.9 mm.

Preferably, the front planar sector 16*c* and the rear planar sector 16*d* have respective thicknesses "Sc" and "Sd" which are the same and preferably between 0.25 mm and 0.8 mm.

Preferably, the compensating planar sector 16*e* has a thickness "Se" which is less than the thickness "Sc" of the front planar sector 16*c* and/or the thickness "Sd" of the rear planar sector 16*d*. For example, the compensating planar sector 16*e* has a thickness "Se" of between 0.20 mm and 0.25 mm.

In a possible embodiment, the nozzle 15 is an insert 20 placed around the internal channel 7 and comprising at least two portions 21, 22 made separately.

Preferably, the two portions 21, 22 are coupled at a plane parallel to the main longitudinal direction 8, for example, a horizontal plane. Preferably, the portions 21, 22 of the insert 20 are associated with the base 12 and the cover 13 of the forming beam 2, respectively. More specifically, the portion 21 located above the channel 7 is associated with the cover 13 and the portion 22 located below the channel 7 is associated with the base 12.

In a possible embodiment, compensating means 23 are provided which are interposed between at least one portion 21, 22 of the insert 20 and the cover 13 and/or the base 12, respectively. Preferably, the compensating means are interposed between the portion 21, which is located above the channel 7, and the cover 13. The compensating means are configured to keep the position of the two portions 21, 22 relative to each other unchanged when the working distance between the base 12 and the cover 13 is changed. In effect, this working distance may be adjusted as a function of the diameter of the rod 4 to be made.

Preferably, the compensating means 23 comprise at least one elastic element, preferably a spring 24.

This invention also relates to a method for making cigarette filters and which can be implemented, for example, by a making machine as described above. The method comprises a step of inserting a tow 3 of filter material impregnated with a plasticizing fluid into the channel 7 of the forming beam 2. The tow 3 is carried along the feed path 10 by porous conveyor means 9. The method also comprises a step of blowing a flow of steam into the channel 7 transversely thereto by means of a nozzle 15. The step of blowing the steam is carried out by differentiating the thickness of the orifice 17 for steam flow through the nozzle 15. Preferably, the thickness of the orifice 17 for flow through the nozzle is differentiated according to the position of the feed duct 18 relative to the inlet duct 19.

The operation of the filter making machine disclosed in the foregoing is described below.

While the tow 3 moves along inside the forming beam 2, a jet of steam is blown onto it through the nozzle 15. Preferably, the machine 1 comprises a main channel 25 which feeds all the treatment stations 14, in particular all the inlet ducts 19 located along the forming beam.

The steam follows the flow direction 19*a* along the inlet duct 19 and enters along the feed path "A" defined by the feed duct 18. The feed path is optimized because it leads directly into the flow orifices 17*a*-17*e* (and thus into the overall flow orifice 17) without excessive load losses and expansions. More specifically, the lateral section "T" of the feed duct surrounds and circumscribes the overall planar flow orifice to provide a direct steam supply flow.

Thanks to the presence of at least two flow orifices of different thicknesses, the steam flow is distributed uniformly and optimally.

More specifically, the lateral planar sectors 16*a*, 16*b* are greater in thickness in order to compensate for the lateral position relative to the inlet duct 19. Moreover, the presence of the compensating planar sector 16*e* of reduced thickness allows compensating for the absence of the conveyor means 9 at the tow portion 11 and thus for the smaller load losses which the steam meets before penetrating the tow.

If compensating means are provided, the steam flow feed path can be optimized and made independent of the adjustment of the working distance between the base and lid of the forming beam when the diameter of the tow is adjusted.

Alternatives to what is described and illustrated herein are possible. In particular, a cigarette filter making machine may be provided which, independently of the type of nozzle and of the presence of the planar sectors, comprises the compensating means 23 interposed between at least one portion 21, 22 of the insert 20 and the cover 13 and/or the base 12, respectively, in order to keep the position of the two portions 21, 22 relative to each other unchanged when the working distance between the base 12 and the cover 13 is changed.

In this case, therefore, the making machine comprises a forming beam 2 having an internal channel 7 extending along a main longitudinal direction 8 and adapted to receive a tow 3 of filter material impregnated with a plasticizing fluid. The transverse cross section of the channel 7 changes along the main longitudinal direction 8 in such a way as to impart a predetermined shape to the tow 3 to form the continuous rod 4 of filter material. Porous conveyor means 9 are configured to slide in the channel 7 of the forming beam 2 along the main longitudinal direction 8 and to carry the tow 3 along a feed path 10. The conveyor means are adapted to comply with the shape of the transverse cross section of the internal channel 7 and to be at least partly wrapped around the tow 3. At least one treatment station 14 located along the feed path 10 comprises at least one nozzle 15 configured to blow a flow of steam into the internal channel 7 transversely thereto. Advantageously, the nozzle 15 is an insert 20 placed around the internal channel 7 and comprising at least two portions 21, 22 made separately. The forming beam 2 comprises a base 12 and a cover 13 closable over the base 12 along a plane parallel to the main longitudinal direction 8 to form the internal channel 7, and the portions 21, 22 of the insert 20 are associated with the base 12 and the cover 13, respectively. The compensating means 23 are interposed between at least one portion 21, 22 of the insert 20 and the cover 13 and/or the base 12, respectively. For example, the compensating means 23 comprise at least one elastic element, preferably a spring 24.

In this embodiment, the presence of the plurality of planar sectors 16*a*-16*e* as described above is a secondary, optional feature.

The invention claimed is:

1. A machine for making cigarette filters, comprising:

a forming beam having an internal channel extending along a main longitudinal direction and adapted to receive a tow of filter material impregnated with a plasticizing fluid, wherein the internal channel has a transverse cross section, the transverse cross section including a changing shape along the main longitudinal direction in order to impart a desired shape to the tow to form a continuous rod of filter material;

a porous conveyor belt to slide in the internal channel of the forming beam along the main longitudinal direction and to carry the tow along a feed path, the porous conveyor belt complies with the shape of the transverse cross section of the internal channel and being at least partly wrapped around the tow, a treatment station located along the feed path and comprising a nozzle to blow a flow of steam into the internal channel transversely thereto, wherein the nozzle comprises a plurality of planar sectors positioned transversely to the internal channel, the plurality of planar sectors defining a plurality of planar flow orifices, with each of the plurality of planar sectors defining a respective planar flow orifice placed directly in communication between a steam feed duct positioned around the respective planar flow orifice and the internal channel, with at least two of the plurality of planar flow orifices having different thicknesses along the main longitudinal direction, and wherein the plurality of planar sectors are in mutual communication with each other, defining an uninterrupted planar flow orifice around the internal channel.

2. The machine according to claim 1, wherein the nozzle comprises:

two lateral planar sectors located laterally of the internal channel relative to an inlet duct of the steam feed duct, a front planar sector located between the inlet duct of the steam feed duct and the internal channel, and a rear planar sector located on an opposite side of the internal channel relative to the inlet duct, wherein the two lateral planar sectors have respective thicknesses which are greater than at least one chosen from a thickness of the front planar sector and a thickness of the rear planar sector.

3. The machine according to claim 2, wherein the nozzle comprises a compensating planar sector adjacent a portion of the tow not wrapped by the porous conveyor belt, the compensating planar sector having a thickness which is smaller than at least one chosen from the thickness of the front planar sector and the thickness of the rear planar sector.

4. The machine according to claim 3, wherein the compensating planar sector has a thickness of between 0.20 mm and 0.25 mm.

5. The machine according to claim 3, wherein the nozzle includes two rear planar sectors and the compensating planar sector is located on the opposite side of the internal channel relative to the inlet duct, at a central position between the two rear planar sectors.

6. The machine according to claim 2, wherein the two lateral planar sectors have respective thicknesses which are the same and between 0.3 mm and 0.9 mm.

7. The machine according to claim 2, wherein the front planar sector and the rear planar sector have respective thicknesses which are the same and between 0.25 mm and 0.8 mm.

8. The machine according to claim 1, wherein the respective planar flow orifice is in communication with the steam feed duct at a lateral section of the steam feed duct.

9. The machine according to claim 1, wherein the steam feed duct extends along a feed path which is polygonal in shape and wherein the plurality of planar sectors run parallel to one side of the feed path.

10. The machine according to claim 1, wherein the plurality of planar sectors run parallel to a steam flow direction along the inlet duct of the steam feed duct.

11. The machine according to claim 1, wherein the nozzle is an insert placed around the internal channel and includes two separate portions.

12. The machine according to claim 11, wherein the forming beam comprises a base and a cover closable over the base along a plane parallel to the main longitudinal direction to form the internal channel and the two separate portions of the insert are associated with the base and the cover, respectively.

13. The machine according to claim 12, and further comprising a compensating device interposed between one of the two separate portions of the insert and at least one chosen from the cover and the base, respectively, the compensating device being configured to keep a position of the two separate portions relative to each other unchanged when a working distance between the base and the cover is changed.

14. The machine according to claim 13, wherein the compensating device comprises at least one elastic element.

15. The machine according to claim 13, wherein the compensating device comprises a spring.

16. The machine according to claim 11, wherein the two separate portions of the insert are coupled at a plane parallel to the main longitudinal direction.

17. The machine according to claim 1, wherein the steam feed duct extends along a feed path which is rectangular in shape and wherein the plurality of planar sectors run parallel to one side of the feed path.

18. The machine according to claim 1, wherein each planar sector of the plurality of planar sectors has a flat shape extending transversely to the internal channel.

19. The machine according to claim 1, wherein the plurality of planar sectors laterally merge into each other such that the uninterrupted planar flow orifice extends in a continuous manner around the internal channel and produces a steam blade leading into the internal channel.

20. The machine according to claim 19, wherein the planar sectors laterally merge upstream from reaching the internal channel.

21. The machine according to claim 1, wherein each planar sector of the plurality of planar sectors has a flat shape extending perpendicularly to the internal channel.

22. The machine according to claim 1, wherein each planar sector is delimited by parallel main walls and wherein said main walls extend perpendicularly to the internal channel.

23. The machine according to claim 1, wherein the plurality of planar sectors are in mutual communication with each other upstream of the internal channel and along a majority length of the planar flow orifices.

* * * * *